US005388824A

United States Patent [19]

Reimers

[11] Patent Number: 5,388,824

[45] Date of Patent: Feb. 14, 1995

[54] POCKET GOLF-AID DEVICE

[76] Inventor: James F. Reimers, 4900 Pear Ridge Dr. #404, Dallas, Tex. 75287-3110

[21] Appl. No.: 179,320

[22] Filed: Jan. 10, 1994

[51] Int. Cl.[6] ..... A63B 57/00

[52] U.S. Cl. ..... 273/32 A; 273/32 B

[58] Field of Search ..... 273/32 R, 32 A, 32 B, 273/162 R, 162 F, 162 D

[56] References Cited

U.S. PATENT DOCUMENTS

| | | | |
|---|---|---|---|
| 3,310,879 | 3/1967 | Brzezinski et al. | 273/32 B X |
| 3,539,017 | 11/1970 | Johnson | 273/32 B |
| 4,998,726 | 3/1991 | Budnick | 273/32 B X |
| 5,022,650 | 6/1991 | Madock | 273/32 B X |

*Primary Examiner*—George J. Marlo

*Attorney, Agent, or Firm*—Michael G. Berkman

[57] ABSTRACT

A compact, manually-manipulable device constituting an assembly of golfing related accessories and aids secured in and retractably extendible from a body or housing of the device. Included as independent functional elements of the device are a divot fixer, a probe-like club face groove cleaner, and a wire brush. Additionally, a ball marker is removably secured in the body of the device. Each of the probe, brush and divot repairer components is quickly and easily selectively slideably extended for functional use, while positive securement to the body of the device is preserved. The device may conveniently be carried in one's pocket for ready retrival. The device is known by the trademark POCKET CADEE.

5 Claims, 2 Drawing Sheets

POCKET GOLF-AID DEVICE

BACKGROUND AND FIELD OF THE INVENTION

The present invention relates to a device finding utility as a convenient assembly of mechanical components useful as aids for a golfer. More particularly, the invention is directed to a packeted group of independently manipulable tool-like elements and a ball marker disc uniquely adapted for use during the playing of golf.

Each of the several tools and the ball marker of the composite, unitary article which constitutes the present invention is believed to be known individually, as a useful article popular with golfers. Each meets and fulfills a known and recognized special need.

It is not unknown in the art for a golfer to carry with him or her, for example as additions to various other paraphenalia contained in his or her golf bag, an assemblage of tools or gadgets for performing various operations for enhancing the game and for contribution to its general enjoyment. As a practical matter, however, any particular tool, etc. sought is not usually conveniently or readily at hand when needed. The expected or associated benefit thus ordinarily fails to be realized. Inconvenience gives rise to abandonment of purpose and surrender of benefits.

It is, therefore, a principal aim of the present invention to provide a convenient, readily-available and easily-employed assortment of tools and related gadgets finding spcial utility in the sport of golf. A related aim of the invention is to ensure that the items are always readily at hand for prompt and effective retrieval and use.

Features of the assembly of the invention are that all of the items are combined as an assembly and that each item is, never-the-less, immediately and readily available, in a functional mode, as it may be needed.

SUMMARY OF THE INVENTION

It is a goal of the present invention to provide as a unitary assembly, a composite of separate and individually operable and usable tools and a ball marker disc, each selectively at hand for immediate and effective employment, as may be required.

A related object of the invention is to assemble the special and diverse components of the invention in body-like housing or holder of relatively small physical dimensions, enabling the device to be conveniently carried in one's pocket.

An important feature of the invention is that each component of the assembly is recessed or bodily confined within the housing or holder in a safe, retracted and protected mode when not in use.

A related feature of the invention is that there is provided, for each of the tool elements of the assembly, digitally-manipulable controls for effecting extension or physical protrusion of each tool element, selectively, as required, to bring the particular tool into an operational disposition or configuration.

Yet another feature of the invention is that there is provided for each of the elements housed in the packet of the invention a protruding knob, bar, rod or button by means of which each particular item may be physically extended or grasped preparatory to its employment for its intended purpose.

An important practical feature of the assembly of the invention is that the housing in which the units are retained is conveniently quite small, being about 3 inches long, $\frac{3}{4}$ inch wide, and having a body thickness of about $\frac{3}{8}$ inch. With the tool elements extended, the article has an overall length of about $4\frac{1}{2}$ inches.

A related feature of the invention is that its several functional tool elements are exceedingly strong, physically, the groove cleaner, divot fixer and brush being made of steel and steel wire.

Yet another feature of the invention is that the ball marker component of the assembly is preferably made of plastics material and constitutes a disc with an integrally formed post-like shaft or stem. The latter is received within a cooperating bore in the body of the housing of the assembly with the disc nesting in a mating shallow recess formed in the surface of the housing body itself.

A related feature of the invention is that there is provided a slot or slotted zone between the disc and the body at the end of the body to facilitate access to the disc edge during lifting removal of the marker from the body or housing of the device.

A practical feature of the invention is that the body or housing of the device is composed of durable metal or of a high-strength plastics composition.

In a preferred embodiment of the invention the body of the housing includes planar surfaces adapted to display selectable indicia imprinted thereon.

Other and further objects, features and advantages of the invention will be evident upon a reading of the specifications, considered in conjunction with the drawings.

DETAILED DESCRIPTION OF ILLUSTRATED EMBODIMENT

Figure 1:
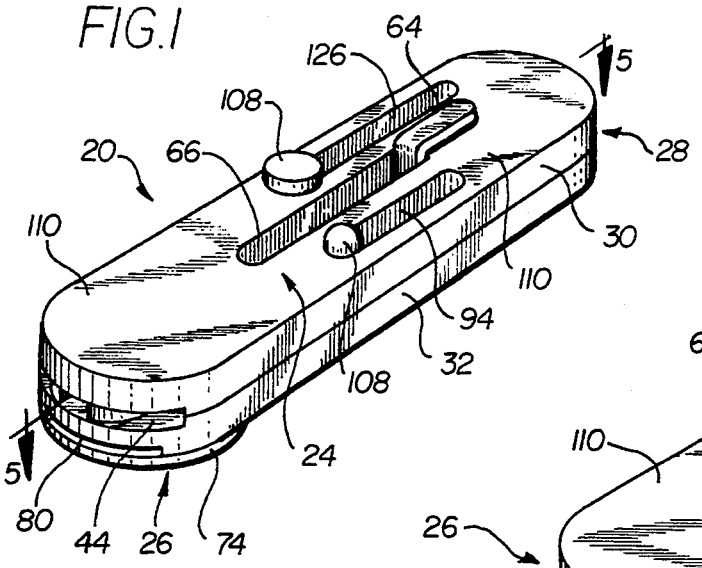
FIG. 1 is a perspective view of the golf-aid device of the invention With components in a retracted mode.

The aims and objects of the present invention are achieved, in accordance with the invention, by providing, for use in conjunction with the playing of a game of golf, a small, pocket-carried device or "Pocket Cadee". The device constitutes a compact and specially arranged assembly of tool-like aids or accessories finding special utility in the sport of golfing.

The invention is characterized in that the tool elements of the assembly are each selectively readily manually shiftable from a retracted or stand-by mode in which each tool is fully retained and safely confined within the physical boundaries of the housing or body of the device, and a projecting or extending disposition in which each "tool" is exposed to assume an operational or functional spatial orientation or attitude. Linkage rods or bars attached to the tool elements themselves are fastened to pins, knobs, or posts extending beyond the body of the housing and by means of which the tool elements are accessed and manually positioned-each as required for use.

The ball marker component of the assembly is preferably of a plastics composition and is removably retained, "at ready", by means of a stub shaft which is sleeved into a cooperating bore in the body of the device. The body or housing of the device is of metal or of a high strength plastics material, The tool elements themselves are preferably steel.

Referring more particularly to the drawings, and specifically to FIGS. 1 through 5, for purposes of illustrative disclosure and not in any limiting sense one preferred embodiment of the golf aids assembly 20 of the invention is shown as including an elongate body or housing 24 having curved front and rear end sectors 26 and 28. In the particular embodiment of the invention illustrated, the body 24 consists of an upper half 30 and a lower half 32, for facilitating assembly. The two halves are glued, pinned, fused, soldered or otherwise secured to one another after necessary machining and after placement of inner, captive elements.

Figure 2:
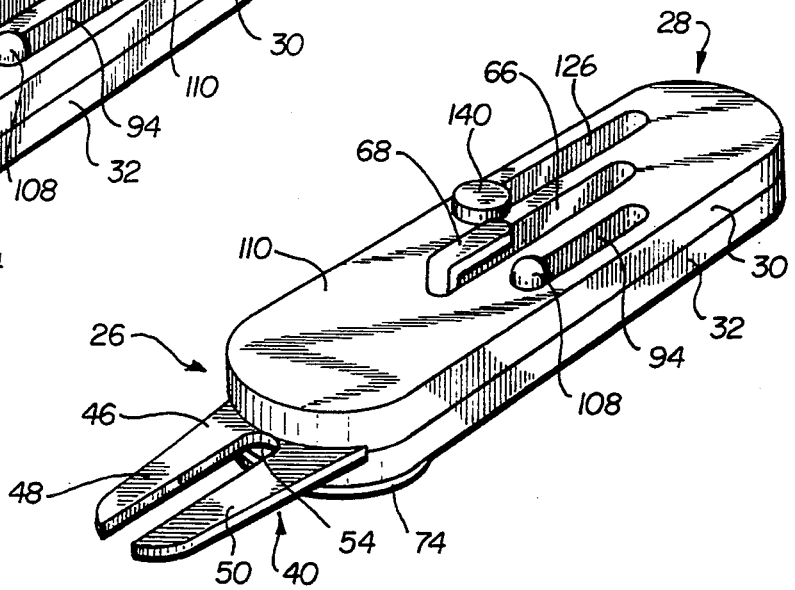
FIG. 2 is a view similar to FIG. 1 but showing the divot-fixer component in an extended, functional position.
Figure 5:
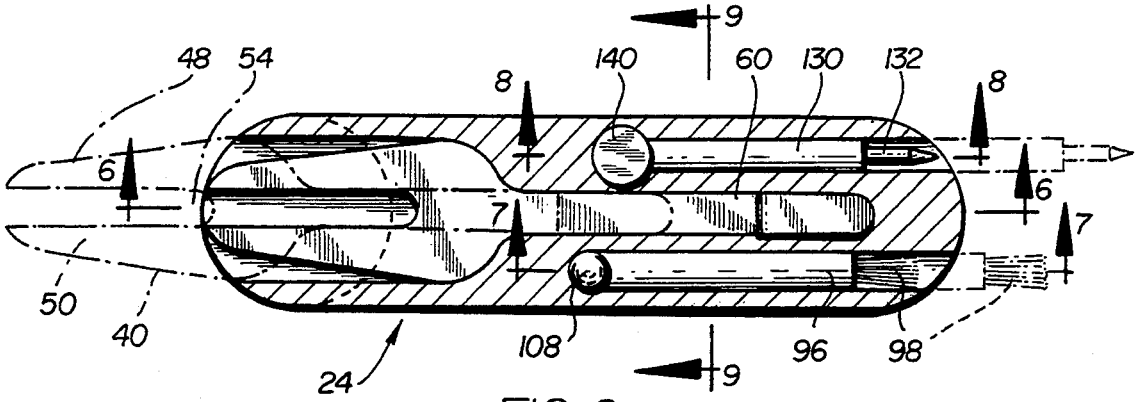
FIG. 5 is a cross-sectional view taken substantially on the lines 5—5 of FIG. 1 but showing schematically the manner in which the extendible components are manipulated.
Figure 6:
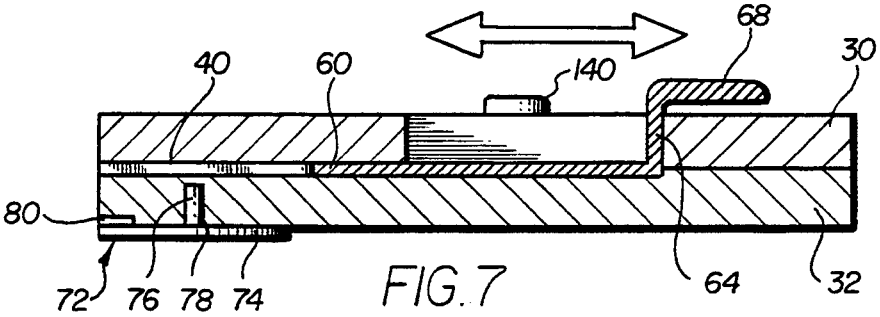
FIG. 6 is a cross-sectional view taken substantially on the lines 6—6 of FIG. 5 and showing the control bar for extending and retracting, the divot fixer component of the device.

As seen in FIGS. 2 and 6, a fork-like divot fixer 40 is slideably sandwiched and confined between the upper 30 and lower 32 parts of the body 24, portions of the interior of the body 24 having been cut away 44 to accommodate the plate-like platten 46. As shown in FIGS. 5 and 6, the divot-fixer is generally of a fork-like configuration and consists of two laterally spaced tines or flat fingers 48 and 50 extending to a bight zone 54.

At its distal end 58, interiorly of the body 24, the divot-fixing fork 40 is integrally joined to an extension bar 60 (FIG. 6). The latter is connected to an upwardly extending section 64 which projects through an elongate slot 66 formed in the body section 30 and terminates in a horizontal flat end sector 68. The latter overlies the body 30 of the assembly 20 and serves as a manual control for sliding extension of and retraction of the divot fixer prongs 48 and 50.

As shown in FIGS. 1 and 2, and as best seen in FIG. 6, a ball marker 72 includes a disc 74 having an integrally formed shaft-like post 76 removably secured to the body 24 of the device 20 in the lower section 32 at the forward end 26 thereof. The post 76 is matingly received in a cooperating bore 78 formed in the lower body section 32 and opening downwardly. As shown in FIG. 1 and in FIG. 6, the lower section 32 of the body 24 of the device 20 is cut away at its lower, forward extremity to define a recess 80 to facilitate finger access to the disc 74 during dislodgement of the ball marker 72 for use.

Figure 7:
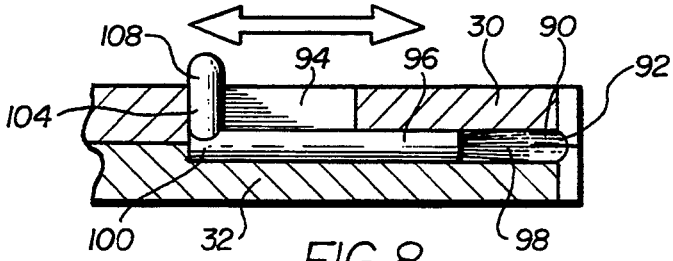
FIG. 7 is a cross-sectional view taken substantially on the lines 7—7 of FIG. 5 and indicating schematically the manner in which the brush component of the device is manipulated.

At its end 28 opposite that end 26 in which the divot fixer 40 resides, and displaced to one side of the device 20, the body 24 is formed with an elongate passage 90 opening 92 endwise. The upper body half 30 is formed with a somewhat shorter overlying slotted section 94 in vertical alignment with and communicating with the passage 90 and opening upwardly. Seated for reciprocal movement lengthwise within the passage 90 is a rod 96 terminating in a wire brush 98 (FIGS. 3, 5, and 7) directed toward the open end 92 of the passage 90.

At its end 100 opposite the brush 98 the rod 96 is joined to an upwardly-directed stub shaft 104 extending transversely through the cutout section 94 and terminating in a stub end 108 which projects above the top surface 110 of the upper body section 30. The stub 108 serves as the actuator means by which the brush-carrying rod is manually advanced endwise to extend and to expose the brush 98 functionally from the body 24 of the device 20.

Figure 3:
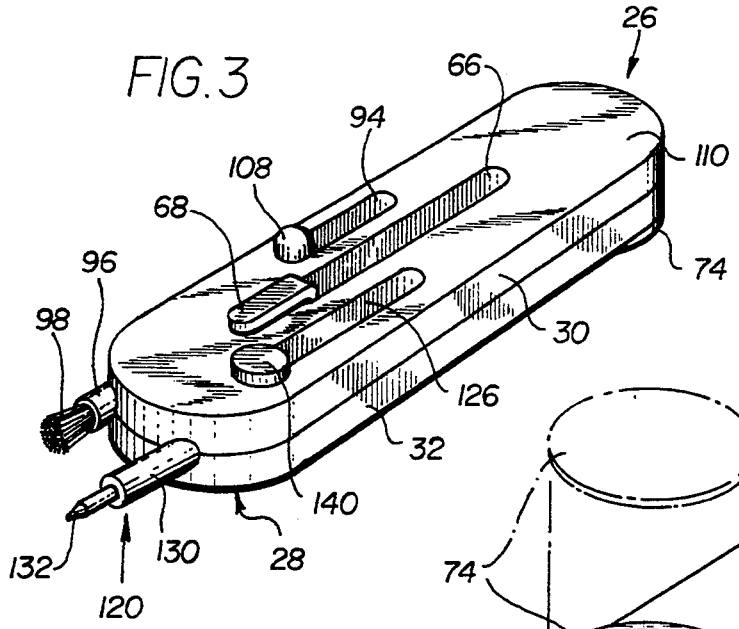
FIG. 3 is a view of the device in a position reversed 180° with respect to FIG. 1 and showing the cleaning probe and the brush components as extended from the body of the device, for use.
Figure 4:
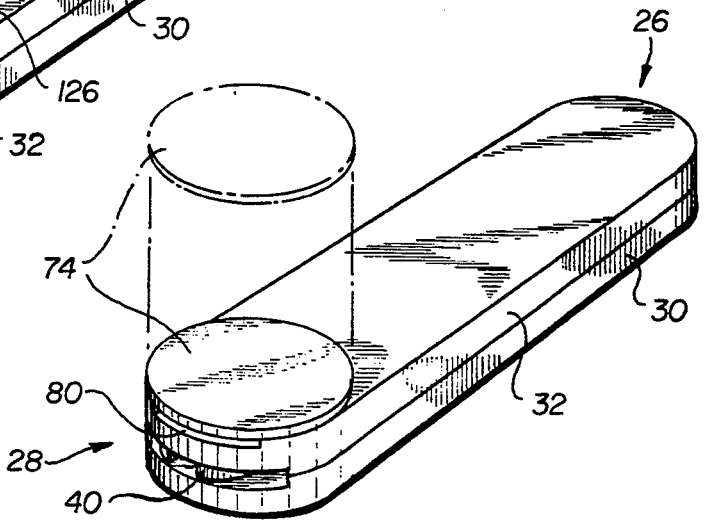
FIG. 4 shows the device of FIG. 1 turned over on its opposite side and indicating schematically the manner in which, the ball marker held in the device is removed for employment.
Figure 8:
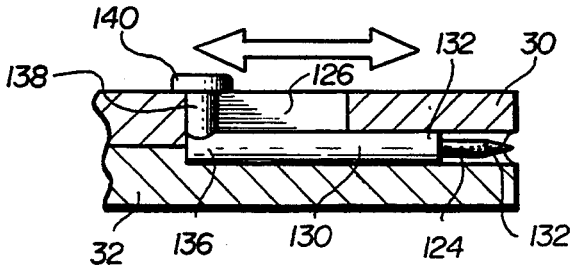
FIG. 8 is a cross-sectional view taken substantially on the lines 8—8 of FIG. 5 and showing the control mechanism for the probe component of the invention.
Figure 9:
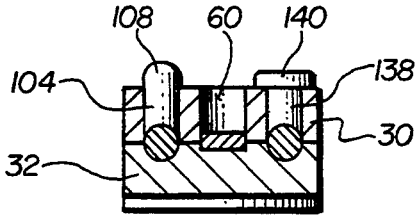
FIG. 9 is a cross-sectional view taken substantially on the lines 9—9 of FIG. 5, and showing the three control bars within the body of the device.

A sharply pointed, spike-like probe 120 completes the collection of tools contained in the housing 24 of the Pocket Cadee (FIGS. 3, 5, and 8). As shown in FIGS. 5 and 8, the body 24 of the device 20 is formed, in an elongate zone paralleling and spaced across from the passage 90 which houses the brush-carrying rod 96, with another tubular passage 124 also opening endwise of the body 24. The upper section 30 is formed with a cutout 126 which overlies the passage 124, is set somewhat rearwardly thereof, and opens upwardly, A rod 130 reciprocally slideable in the passage 124 supports at its forward end 130 a sharpened metal probe 132. The other end 136 of the rod 130 is joined to an upwardly directed arm 138 which projects through the cutout 126 and terminates in a button-like cap 140. The latter serves as a control by means of which the sharp pick-like tool 132 is manipulated.

What is claimed is:

1. A manually manipulable device comprising a housing-like body, and a composite assembly of golfing articles, said articles including golfing aids and accessories, means for securing said articles in said body for retrival and for use, as desired, by a golfer, said articles being characterized in being readily and easily manipulable and being fabricated of high-strength and of durable and corrosion-resistant compositions, each of said articles being extendible from said body during specialized employment thereof, said items including a club-face groove cleaner comprising a hardened steel probe, wire brush means for cleaning ball-impacting faces of clubs, a divot fixer, and a ball marker, control means, independently operable and conveniently positioned for accessing each of said articles and for displacing said articles with reference to said body to effect, selectively, an operational mode for each of said articles, and each of said articles including integrally formed means for retracting said articles into said body when not in use, said housing having top and bottom surfaces including generally planar a real sections for imprinting of selectable visual indicia thereon.

2. The device as set forth in claim 1 wherein said ball marker consists essentially of a thin disc having a stub center shaft extending from an underside thereof, and wherein said body of said device is formed with a bore extending transversely of said body of said device and opening upwardly of a principal face thereof, said shaft adapted matingly to seat within said bore to establish positive engagement therewithin to secure said ball marker to said body of said device.

3. The device as set forth in claim 2 wherein said disc of said ball marker includes a generally planar underface which, in the stored, stand-by mode of the marker, abuts an underside of said housing-like body, and wherein said body is cut away in a zonal area overlying said disc to provide, in conjunction with said disc, a horizontal slot opening endwise to facilitate access to and withdrawal of said disc manually from said body of said device, for use.

4. The device as set forth in claim 1 and further comprising handle means attached to and extending, normally of each of said probe, said brush means and said divot fixer for digital access from a principal face of said body, and wherein said body is formed with a plurality of elongate channel-like slots for sliding movement of said handle means therewithin as each of said probe, said brush means and said divot fixer is selectively extended to a functional mode, and retracted to a stand-by mode into said body of said device.

5. The device as set forth in claim 1 wherein each of said control means includes protrusion means projecting upwardly from said housing and each from the same side thereof for accommodating and for rendering convenient the manual manipulation of said steel probe, said brush means and said divot fixer.

* * * * *